US010287793B1

(12) United States Patent
Anslem et al.

(10) Patent No.: US 10,287,793 B1
(45) Date of Patent: May 14, 2019

(54) UMBRELLA ANCHORING SYSTEM

(71) Applicants: David P. Anslem, Bourne, MA (US); Ann M. Anslem, Bourne, MA (US)

(72) Inventors: David P. Anslem, Bourne, MA (US); Ann M. Anslem, Bourne, MA (US)

( * ) Notice: Subject to any disclaimer, the term of this patent is extended or adjusted under 35 U.S.C. 154(b) by 0 days.

(21) Appl. No.: 15/877,595

(22) Filed: Jan. 23, 2018

(51) Int. Cl.
*E04H 12/22* (2006.01)

(52) U.S. Cl.
CPC ..... *E04H 12/2215* (2013.01); *E04H 12/2269* (2013.01)

(58) Field of Classification Search
CPC ..... A45F 3/44; A45B 2023/0012; E04H 12/2269; E04H 12/2215; E04H 12/347
See application file for complete search history.

(56) References Cited

U.S. PATENT DOCUMENTS 2,018,260 A 10/1935 Henderson
3,612,287 A 10/1971 Maltese
4,240,766 A 12/1980 Smith et al.
5,040,251 A 8/1991 Hanford
6,675,819 B2 * 1/2004 Arrowood ..... A45F 3/44 135/118
6,745,529 B2 6/2004 Beltran
7,003,919 B2 2/2006 Riker
7,264,210 B2 * 9/2007 Yu ..... A45F 3/44 135/16
7,780,139 B2 8/2010 Markert
7,921,616 B2 * 4/2011 Reyneveld ..... E02D 27/42 52/295
8,371,319 B2 * 2/2013 Meibos ..... A45B 23/00 108/50.12
8,444,105 B2 5/2013 Silvestri
9,285,076 B2 * 3/2016 Paolucci ..... E04H 12/2215
9,447,600 B2 9/2016 Walker
9,554,630 B1 * 1/2017 Patel ..... A45B 25/02
9,719,272 B1 * 8/2017 Torsiello, Jr. ..... E01F 13/024
2004/0129184 A1 * 7/2004 Kraker ..... A45B 25/00 108/50.12
2004/0169121 A1 * 9/2004 Winn ..... A45B 1/00 248/530
2006/0241647 A1 * 10/2006 Chen ..... B25D 1/00 606/100
2010/0200724 A1 * 8/2010 Kukuk ..... A45B 25/00 248/530

(Continued)

*Primary Examiner* — Bradley Duckworth
(74) *Attorney, Agent, or Firm* — Goldstein Law Offices, P.C.

(57) ABSTRACT

An umbrella anchoring system for selectively supporting and anchoring an umbrella to an anchoring surface, comprising a supporting sleeve having a supporting cavity adapted to selectively receive and support the umbrella, and an anchor adapted to detachably connect to the supporting sleeve. The anchor is affixed within an anchoring recess formed within the anchoring surface, and holds the supporting sleeve in a position perpendicular to the anchoring surface. The supporting sleeve may further comprise a tightening assembly which locks the umbrella within the supporting cavity. The supporting sleeve may be detached from the anchor when the umbrella is not in use, leaving the anchoring surface free of obstructions. The umbrella anchoring system may further comprise a base cap which covers the anchor when the supporting sleeve is detached from the anchor.

10 Claims, 8 Drawing Sheets

(56) References Cited

U.S. PATENT DOCUMENTS

| | | | | |
|---|---|---|---|---|
| 2011/0036964 | A1* | 2/2011 | Escola Puig-corve | E04H 12/2269 248/545 |
| 2014/0007487 | A1* | 1/2014 | Schwiebert | E04H 12/2238 43/21.2 |
| 2017/0089509 | A1* | 3/2017 | Bailey | F16B 7/182 |
| 2017/0119134 | A1* | 5/2017 | Dabbs | E04H 12/2215 |
| 2018/0238073 | A1* | 8/2018 | Laffy | E04H 12/2215 |

* cited by examiner

UMBRELLA ANCHORING SYSTEM

TECHNICAL FIELD

The present disclosure relates generally to a system for mounting an umbrella. More particularly, the present disclosure relates to a system for selectively anchoring an umbrella to an anchoring surface, where the system may be dismantled when not in use.

BACKGROUND

Outdoor umbrellas, such as pool, deck, and patio umbrellas, are essential for outdoor activities by providing shade from the sun and protection from precipitation. Outdoor umbrellas can be exposed to strong winds, and as a result these umbrellas are typically mounted in umbrella stands which are large and heavily weighted for stability. However, even weighted umbrella stands may still tip over when subjected to enough force. Alternatively, outdoor umbrellas are often mounted in holders which are bolted to the ground and provide excellent stability.

However, there are situations where outdoor umbrellas must be removed from a deck, patio, or other area to allow for the entire surface to be utilized, or to allow umbrellas to be dismantled and stored during the winter or in advance of extreme weather conditions. Weighted umbrella stands are difficult to move, require significant storage space, and are unsightly and pose a tripping hazard if they are simply left in place. Permanent umbrella holders, by their very nature, cannot be easily removed without potentially damaging the deck or patio.

Therefore, there is a need for an umbrella anchoring system which offers the stability of a permanent umbrella holder, but which can be quickly dismantled in a way that leaves the deck, patio, or other surface free of dangerous or unsightly physical obstructions.

In the present disclosure, where a document, act or item of knowledge is referred to or discussed, this reference or discussion is not an admission that the document, act or item of knowledge or any combination thereof was at the priority date, publicly available, known to the public, part of common general knowledge or otherwise constitutes prior art under the applicable statutory provisions; or is known to be relevant to an attempt to solve any problem with which the present disclosure is concerned.

While certain aspects of conventional technologies have been discussed to facilitate the present disclosure, no technical aspects are disclaimed and it is contemplated that the claims may encompass one or more of the conventional technical aspects discussed herein.

BRIEF SUMMARY

An aspect of an example embodiment in the present disclosure is to provide an umbrella anchoring system which selectively supports an umbrella having an umbrella pole and a canopy, and anchors the umbrella to an anchoring surface having an anchoring recess. Accordingly, the present disclosure provides an umbrella anchoring system comprising a supporting sleeve having a supporting cavity adapted to selectively receive and support the umbrella, and an anchor affixed within the anchoring recess. The supporting sleeve is further adapted to detachably connect to the anchor, while the anchor is adapted to secure the supporting sleeve and the umbrella in a vertical position relative to the anchoring surface.

It is another aspect of an example embodiment in the present disclosure to provide an umbrella anchoring system which can be dismantled when not in use. Accordingly, the prevent disclosure provides an umbrella anchoring system where the anchor has a base plate which is coplanar with the anchoring surface, leaving the anchoring surface free of physical obstructions when the supporting sleeve is detached from the anchor.

It is yet another aspect of an example embodiment in the present disclosure to provide an umbrella anchoring system which securely supports the umbrella when the umbrella is subjected to vertical and lateral forces. Accordingly, the present disclosure describes a supporting sleeve which further comprises a tightening assembly which selectively locks the umbrella pole in place within the supporting cavity.

It is a further aspect of an example embodiment in the present disclosure to provide an umbrella anchoring system which can be installed within a range of different anchoring surfaces, such as concrete decks, patios, paved surfaces, or other planar surfaces. Accordingly, the present disclosure describes an anchoring recess formed by embedding the anchor within an anchoring surface comprising wet concrete. Once the wet concrete is cured, the anchor is permanently affixed within the anchoring recess. The present disclosure further describes an anchoring recess created by boring a depression within an anchoring surface which substantially matches the shape of the anchor, and affixing the anchor therein using an adhesive.

It is yet a further aspect of an example embodiment in the present disclosure to provide a means for covering the anchor and the exposed anchoring recess when the umbrella anchoring system is not in use. Accordingly, the present disclosure describes a base cap having a cap plate and a peg adapted to cover the anchor and the exposed anchoring recess.

The present disclosure addresses at least one of the foregoing disadvantages. However, it is contemplated that the present disclosure may prove useful in addressing other problems and deficiencies in a number of technical areas. Therefore, the claims should not necessarily be construed as limited to addressing any of the particular problems or deficiencies discussed hereinabove. To the accomplishment of the above, this disclosure may be embodied in the form illustrated in the accompanying drawings. Attention is called to the fact, however, that the drawings are illustrative only. Variations are contemplated as being part of the disclosure.

BRIEF DESCRIPTION OF THE DRAWINGS

In the drawings, like elements are depicted by like reference numerals. The drawings are briefly described as follows.

The present disclosure now will be described more fully hereinafter with reference to the accompanying drawings, which show various example embodiments. However, the present disclosure may be embodied in many different forms and should not be construed as limited to the example embodiments set forth herein. Rather, these example embodiments are provided so that the present disclosure is thorough, complete and fully conveys the scope of the present disclosure to those skilled in the art.

DETAILED DESCRIPTION OF THE PREFERRED EMBODIMENTS

Figure 1:
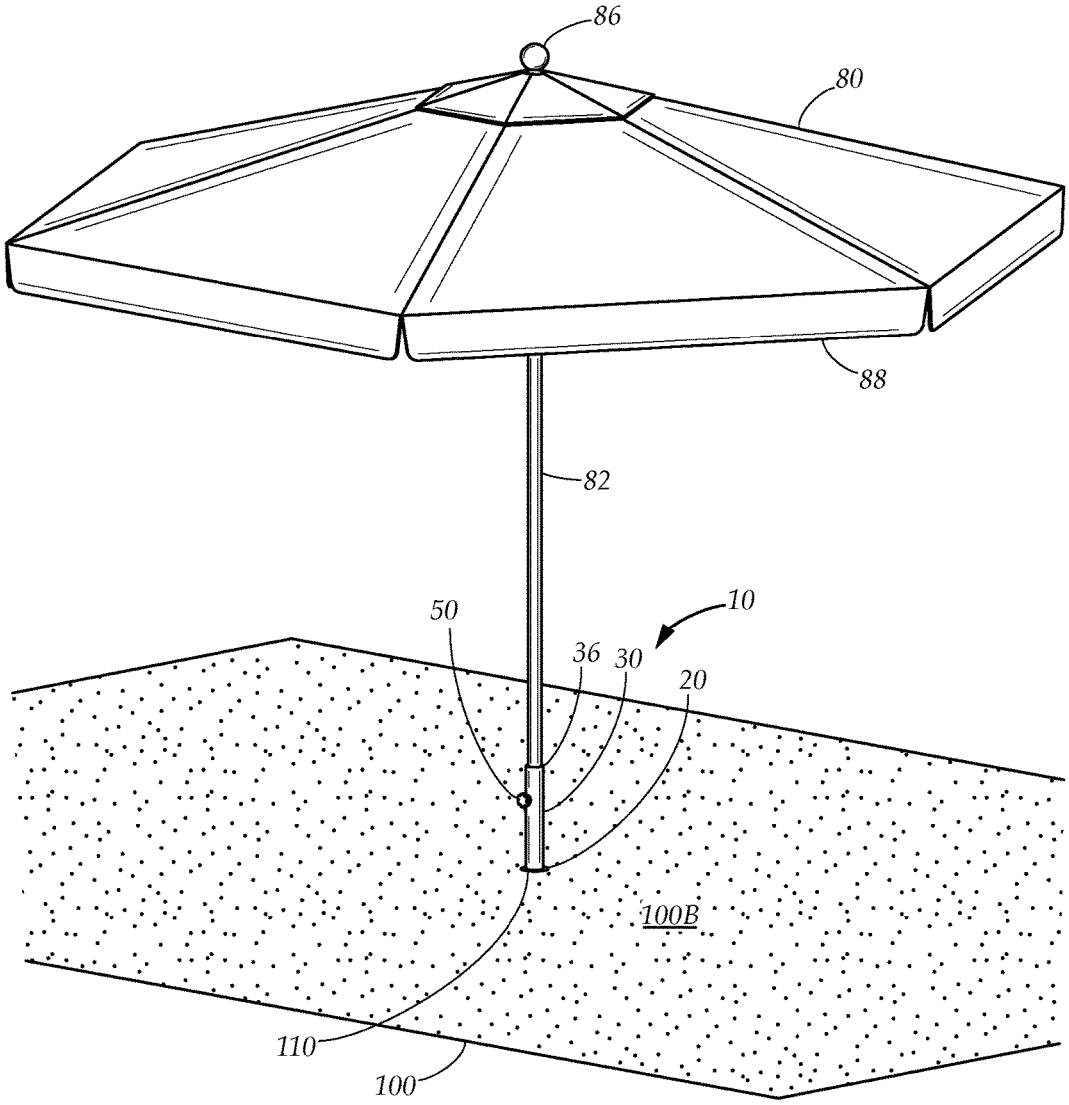
FIG. 1 is diagrammatical perspective view depicting an umbrella anchoring system anchored to an anchoring surface, in accordance with an embodiment of the present disclosure.
Figure 6:
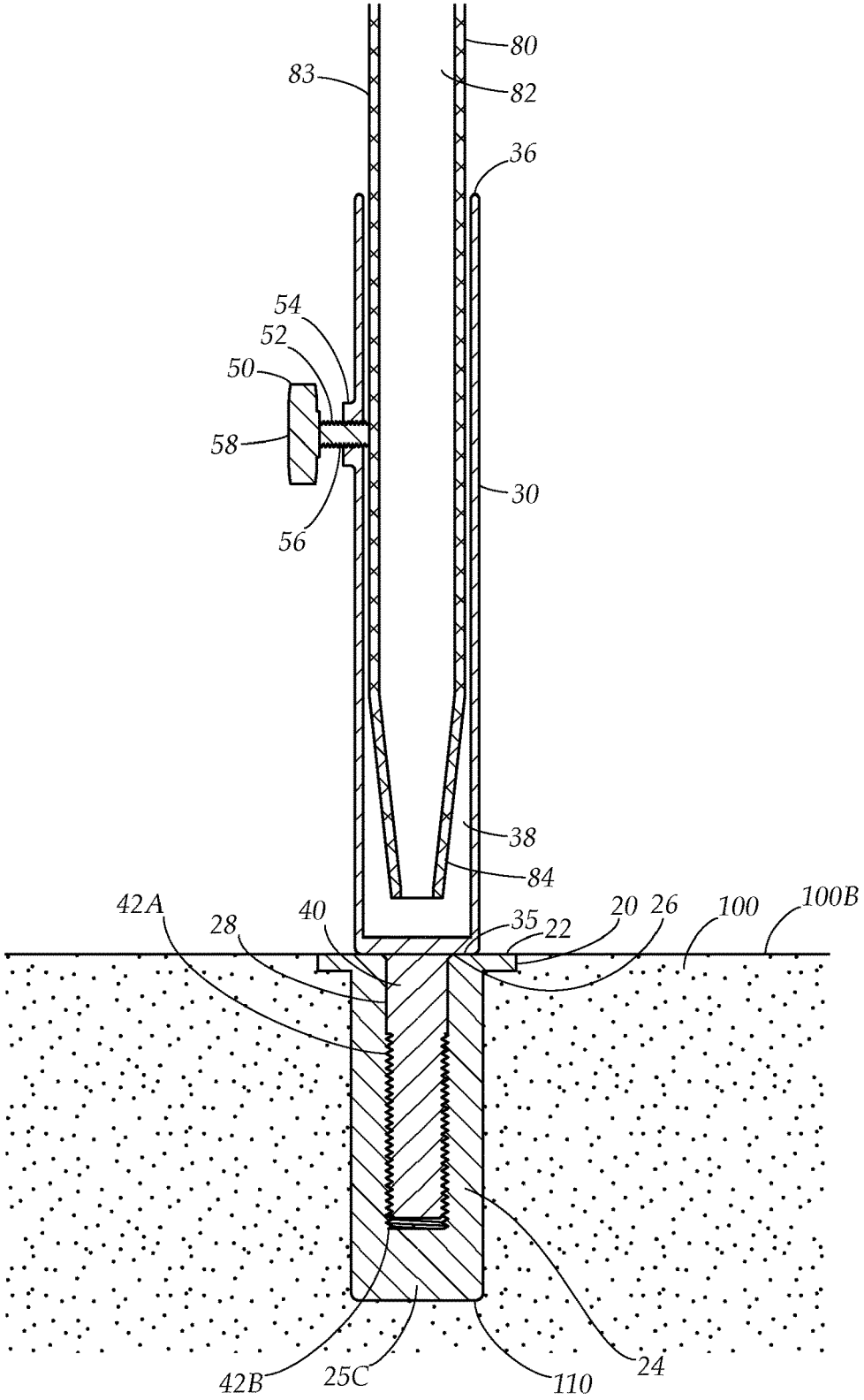
FIG. 6 is a cross section view of the umbrella anchoring system, depicting an umbrella pole received and supported within the supporting cavity, further depicting the anchor affixed within an anchoring recess formed within the anchoring surface, in accordance with an embodiment of the present disclosure.

FIG. 1 illustrates an umbrella anchoring system 10 comprising a supporting sleeve 30 and an anchor 20. Referring to FIG. 6 in addition to FIG. 1, the supporting sleeve 30 is adapted to selectively retain and support an umbrella 80 comprising an umbrella pole 82 having an umbrella pole outer surface 83 and a lower end 84. The umbrella further comprises a canopy 88 supported by the umbrella pole 82. The anchor 20 is affixed in an anchoring recess 110 formed within an anchoring surface 100. The anchoring surface 100 further has a top face 100B, and may be a deck, patio, paved surface, rooftop, or other hard planar surface. The supporting sleeve 30 is further adapted to detachably connect to the anchor 20, allowing the anchor 20 to secure and anchor the supporting sleeve 30, and the umbrella 80 selectively retained therein, against the anchoring surface 100. When the umbrella 80 is not in use, the umbrella 80 may be removed from within the supporting sleeve 30, and the supporting sleeve 30 may further be detached from the anchor 20, leaving the anchoring surface 110 free of obstructions caused by the supporting sleeve or anchor which can be unsightly as well as potentially hazardous.

Figure 2A:
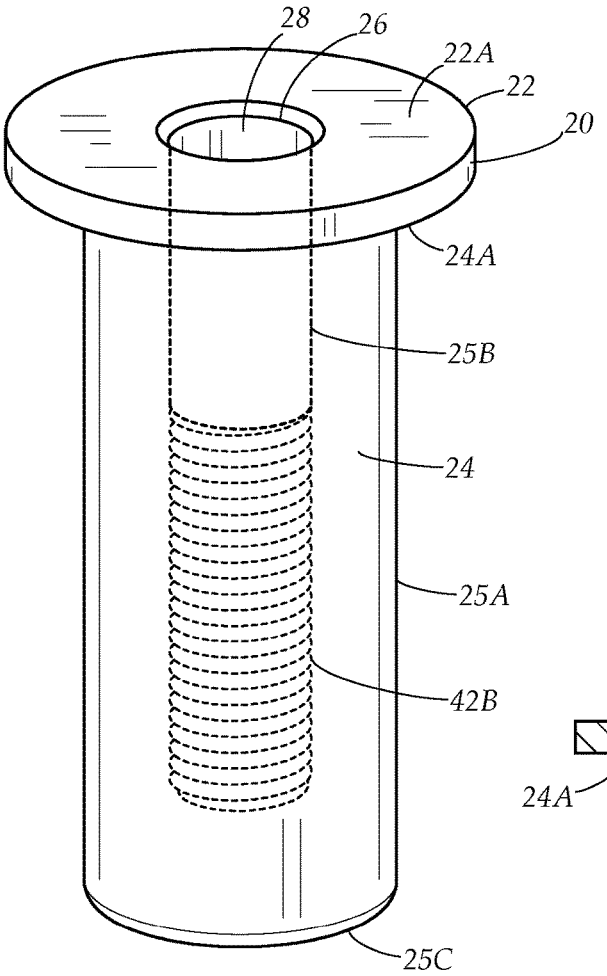
FIG. 2A is a diagrammatical perspective view depicting an anchor comprising a base plate and an anchoring sleeve, further showing a retaining recess within the anchoring sleeve represented using broken lines, in accordance with an embodiment of the present disclosure.
Figure 2B:
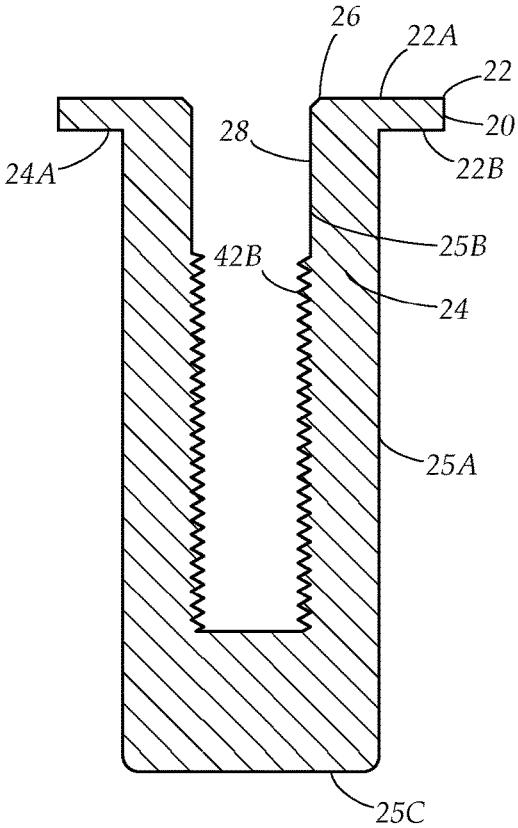
FIG. 2B is a cross section view of the anchor, in accordance with an embodiment of the present disclosure.

Turning now to FIGS. 2A-B, while continuing to refer to FIG. 1, the anchor 20 comprises a base plate 22 having an upper face 22A and a lower face 22B, and further comprises an anchoring sleeve 24 projecting downwardly from the lower face 22B of the base plate 22. The anchoring sleeve comprises a top 24A which is joined to the lower face 22B of the base plate 22, an outer surface 25A, an inner surface 25B, and a bottom 25C positioned opposite the top 24A. The anchoring sleeve 24 may have a diameter which is smaller than, or substantially the same as, the diameter of the base plate 22. In a preferred embodiment, the anchor 20 may be formed from steel, aluminum, or other metal, for resiliency and durability. The anchor 20 further comprises an anchoring opening 26 positioned centrally on the base plate 22, and a retaining recess 28 formed within the anchoring sleeve 24. The retaining recess is defined by the inner surface 25B of the anchoring sleeve and the anchoring opening 26, and opens upwardly at the anchoring opening 26.

Figure 7:
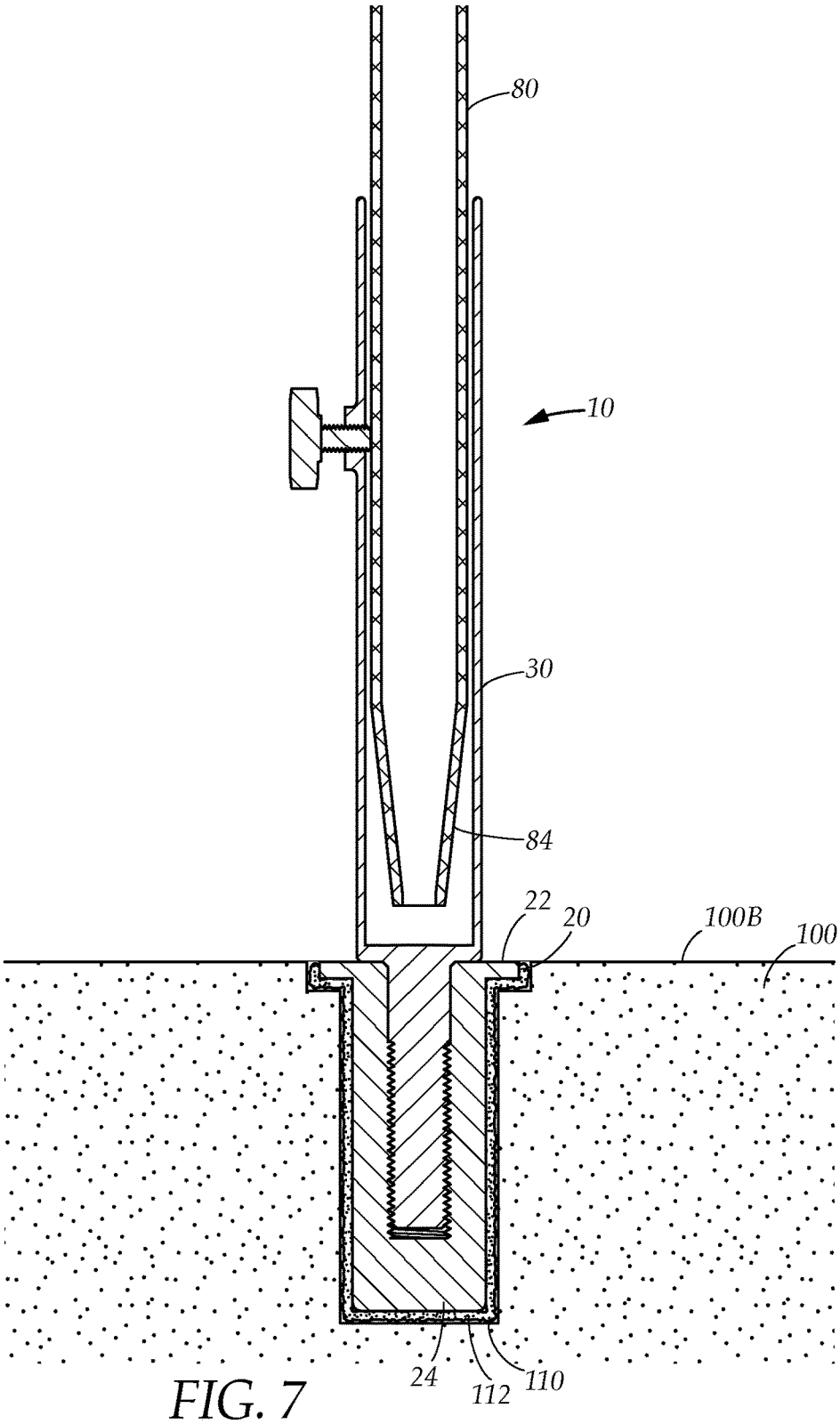
FIG. 7 is a cross section view of the umbrella anchoring system, depicting an alternate embodiment of the anchoring recess where the anchor is affixed therein using an adhesive.

Turning to FIG. 6, while continuing to refer to FIGS. 2A-B, the anchoring recess 110 is formed within the anchoring surface 100 as a depression below the top face 100B, which conforms to the shape of the anchor 20. In certain embodiments, the anchoring surface 100 may be formed from concrete. The anchoring recess 110 may be formed by embedding the anchor 20 within the concrete of the anchoring surface 100 when the concrete is still wet, allowing the concrete to conform to the shape of the anchor 20 and create the anchoring recess 110. Once the concrete is cured, the anchor 20 remains affixed within the anchoring recess 110, and the concrete forms a permanent adhesive bond with the anchor 20. The upper face 22A of the base plate 22 is oriented so that the anchoring opening 26 opens upwardly away from the anchoring surface 100. In a preferred embodiment, the anchor 20 may be positioned within the anchoring recess 110 such that the base plate 22 does not extend upwardly beyond the plane defined by the top face 100B of the anchoring surface 100. The upper face 22A of the base plate 22 may either be coplanar with the top face 100B, or be positioned parallel with but below the top face 100B. Turning to FIG. 7, the anchoring recess 110 may alternatively be formed where the anchoring surface 100 is already in place, allowing the umbrella anchoring system 10 to be positioned on a deck, patio, or other substantially planar surface. For example, the anchoring recess 110 may be prepared by boring into the anchoring surface 100 with a drill or other tool to create a depression sized to receive the anchor. This depression is filled with an adhesive 112, and the anchor 20 is placed within the hole in contact with the adhesive 112. Once the adhesive 112 cures, the anchor 20 will be permanently affixed within the anchoring recess 110.

Figure 3A:
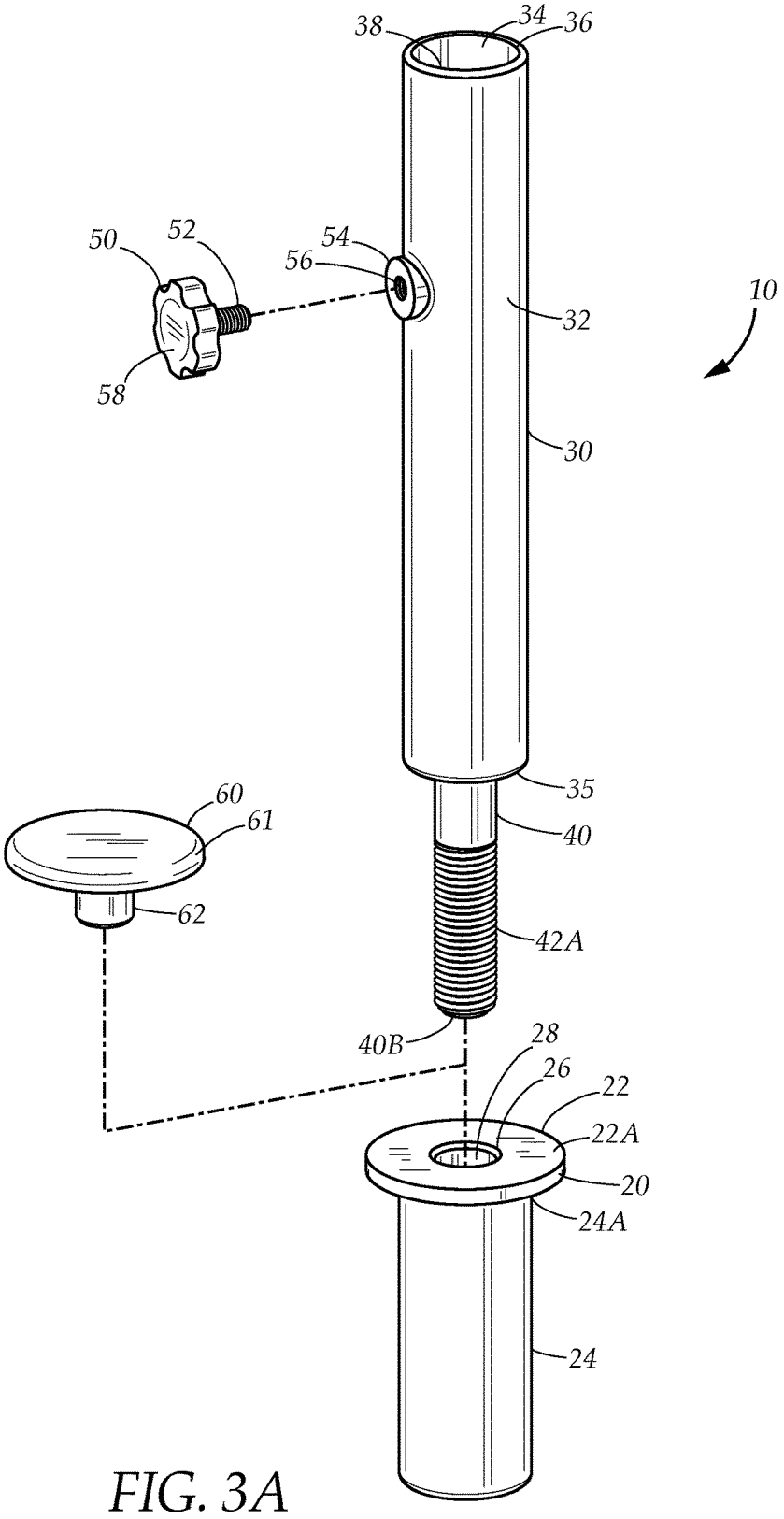
FIG. 3A is an exploded view showing a supporting sleeve in relation to the anchor and further depicting a base cap, in accordance with an embodiment of the present disclosure.
Figure 3B:
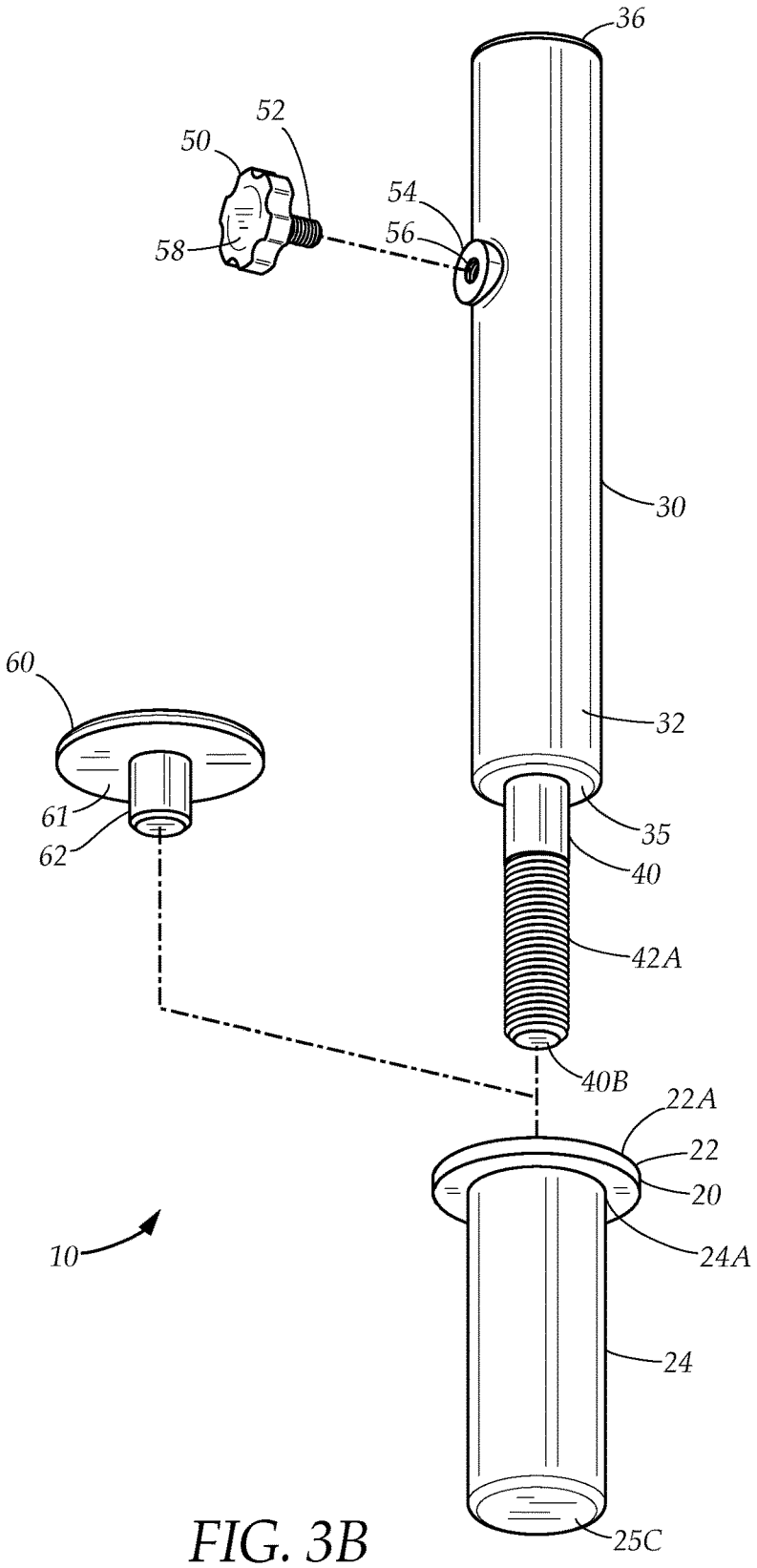
FIG. 3B is an exploded view of the supporting sleeve, anchor, and base cap shown from an alternative perspective.

Referring now to FIGS. 3A-B while simultaneously referring to FIG. 1 and FIGS. 2A-B, the supporting sleeve 30 comprises an open tube having an open end 36, a closed end 35, a supporting sleeve outer surface 32, and a supporting sleeve inner surface 34. In a preferred embodiment, the supporting sleeve 30 may have a cross-sectional shape which is circular or polygonal. The supporting sleeve 30 further comprises a supporting cavity 38 which is defined by the supporting sleeve inner surface 34 and the open end 36, and opens upwardly at the open end. The supporting cavity 38 is sized to receive the umbrella pole 82, and may have a diameter which is substantially similar to or greater than the diameter of the umbrella pole 82.

The supporting sleeve 30 further comprises a retaining member 40, which projects downwardly from the closed end 35 of the supporting sleeve 30 and has a retaining member lower end 40B. The supporting sleeve 30 forms a detachable connection with the anchor 20, and the retaining member 40 has a diameter which is substantially the same or slightly smaller than the diameter of the retaining recess 28, allowing the retaining recess 28 to receive the retaining member 40. In a preferred embodiment, the diameter of the supporting sleeve 30 may be greater than the diameter of the retaining member 40, while the diameter of the base plate 22 may be substantially the same as, or greater than the diameter of the supporting sleeve 30. The retaining recess 28 may further have a means for releasably securing the retaining member 40 within the retaining recess 28. In a preferred embodiment, the supporting sleeve 30 may further comprise a set of retaining member threads 42A disposed on the retaining member 40, and the anchor 20 may further comprise a set of retaining recess threads 42B disposed within the retaining recess 28. The retaining member threads 42A and retaining recess threads 42B are adapted to interlock as the retaining recess 28 receives the retaining member 40, releasably securing the retaining member 40 within the retaining recess 28.

In a preferred embodiment, the detachable connection between the supporting sleeve 30 and the anchor 20 may be formed by aligning the retaining member 40 with the retaining recess 28 through the anchoring opening 26, positioning the retaining member 40 within the retaining recess 28, and rotating the supporting sleeve 30 within the retaining recess 28 until the closed end of the supporting sleeve 30 contacts the upper face 22A of the base plate 22. The supporting sleeve 30 may also be detached from the anchor 22, by rotating the retaining member 40 within the retaining recess 28 and removing the retaining member 40 from the retaining recess 28. In a preferred embodiment, the supporting sleeve 30 is attached to the anchor 20 by rotating the supporting sleeve 30 in a clockwise direction, and is detached by reversibly rotating the supporting sleeve in a counter-clockwise direction. In an alternate embodiment where the diameter of the supporting sleeve 30 is substantially the same as the diameter of the retaining member 40, and the detachable connection may be formed by rotating the retaining member 40 within the retaining recess 28 until the retaining member and retaining recess threads 42A, 42B are fully interlocked and no further rotation is necessary, or until the retaining member lower end 40B contacts the anchoring sleeve bottom 25C.

Figure 4A:
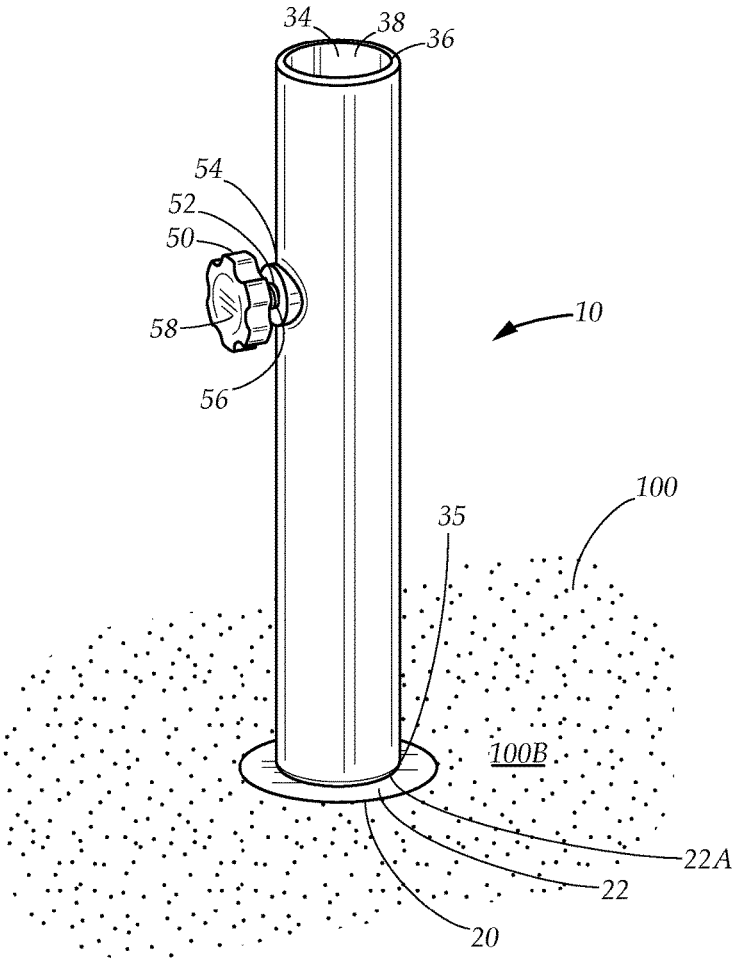
FIG. 4A is a diagrammatical perspective view of the umbrella anchoring system where the supporting sleeve is detachably connected to the anchor, in accordance with an embodiment of the present disclosure.

Turning now to FIG. 4A, while also referring to FIGS. 1 and 6, the umbrella anchoring system 10 is ready to receive the umbrella 80 once the supporting sleeve 30 is detachably connected to the anchor 20 in a position perpendicular to the anchoring surface 100. The umbrella 80 may be installed within the umbrella anchoring system 10 by inserting the lower end 84 of the umbrella pole 82 through the open end 36 of the supporting sleeve 30 and into the supporting cavity 38. Once the umbrella 80 is installed, the umbrella anchoring system 10 supports the umbrella in a vertical position, and is further adapted to ensure the umbrella 80 remains retained when subjected to lateral or vertical forces caused by wind or direct contact with persons or objects.

Figure 5:
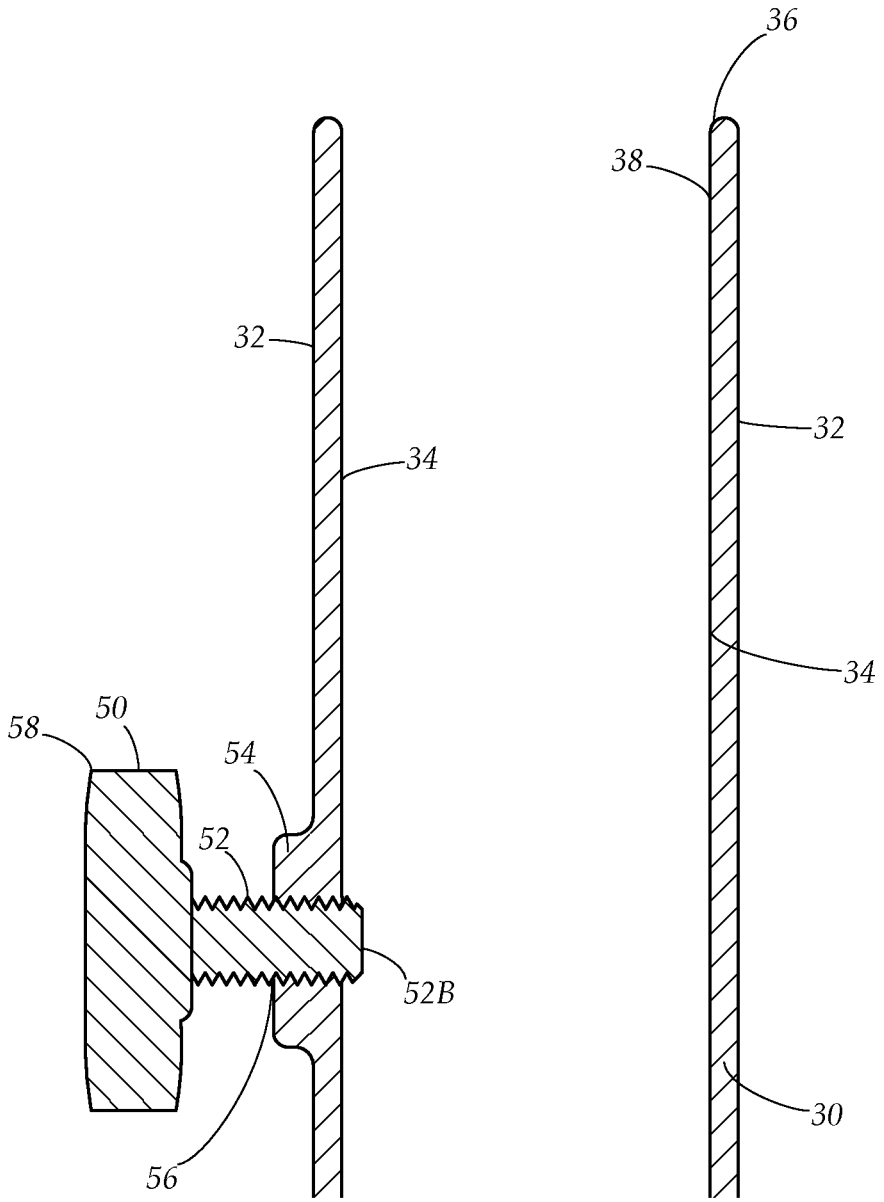
FIG. 5 is a partial cross section view of the supporting sleeve, depicting a supporting cavity within the supporting sleeve, and a tightening assembly, in accordance with an embodiment of the present disclosure.

The supporting sleeve 30 prevents the umbrella 80 from being pulled out of the supporting cavity 38 by a vertical force, such as the upwards vertical force exerted upon the umbrella 80 when the canopy 88 is exposed to strong wind. Lateral force exerted upon the umbrella pole 82 or the supporting sleeve 30 is transferred from the closed end of the supporting sleeve 30 to the upper face 22A of the base plate 22, allowing the lateral force to be dissipated throughout the umbrella anchoring system 10 and preventing the lateral force from being applied entirely to the comparatively thin retaining member 40. Continuing now to FIG. 5 while simultaneously referring to FIGS. 3A and 6, the supporting sleeve 30 may further comprise a tightening assembly 50 adapted to frictionally contact the umbrella pole 82 in order to lock the umbrella pole in place within the supporting cavity 38, thus countering vertical forces which may be applied to the umbrella. In a preferred embodiment, the tightening assembly 50 comprises a tightening rod 52, a tightening point 54 positioned on the supporting sleeve outer surface 32, and a tightening channel 56 which passes through the tightening point 54 and the supporting sleeve outer surface 32 to the supporting sleeve inner surface 34. The tightening rod 52 comprises a tightening handle 58, and a distally oriented first end 52B. The tightening rod 52 and the tightening channel 56 are threaded, allowing the tightening rod 52 to rotatably extend and retract through the tightening channel 56 as the tightening handle 58 is rotated to engage or disengage the tightening assembly 50. When the tightening assembly 50 is engaged, the tightening rod 52 rotatably extends through the tightening channel 56 until the first end 52B of the tightening rod contacts the umbrella pole 82 at the umbrella pole outer surface 83 and pushes the umbrella pole 82 against the supporting sleeve inner surface 34. The frictional contact between the umbrella pole outer surface 83 and the first end 52B of the tightening rod 52B and the supporting sleeve inner surface 34 locks the umbrella pole 82 in place within the supporting cavity 38. When the tightening assembly 50 is disengaged, the umbrella pole 82 is released from the frictional contact with the tightening rod 52 and the supporting sleeve inner surface 34.

When the umbrella 80 is not in use, the umbrella 80 may be removed by withdrawing the umbrella pole 82 from within the supporting cavity 38, and the supporting sleeve 30 may be detached from the anchor 20, leaving only the anchor 20 in place on the anchoring surface 100. Detaching the unused supporting sleeve 30 prevents the supporting sleeve 30 from protruding from the anchoring surface 100 and posing a potential tripping hazard, and allows the anchoring surface 100 to be utilized for other activities.

The umbrella 80 may also be removed from the anchoring surface 100 without first removing the umbrella pole 82 from the supporting sleeve 30. The supporting sleeve 30 may be detached from the anchor 20 while leaving the umbrella 80 secured within the supporting cavity 38. Furthermore, in certain embodiments, more than one anchor 20 may be positioned in anchoring recesses 110 disposed within the anchoring surface 100. By detaching the supporting sleeve 30 while the umbrella 80 remains retained, the umbrella 80 may be quickly repositioned and detachably connected to a different anchor 20, making it unnecessary to have multiple supporting sleeves 30 attached to different anchors 20 across the anchoring surface 100.

Figure 4B:
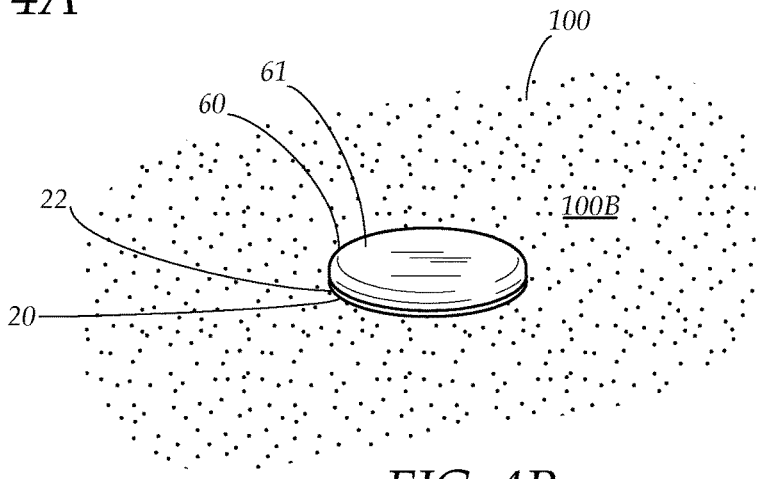
FIG. 4B is a diagrammatical perspective view of the umbrella anchoring system where the supporting sleeve has been detached from the anchor and replaced with the base cap, in accordance with an embodiment of the present disclosure.

Referring to FIGS. 4B and 3A-B simultaneously, the umbrella anchoring system may further comprise a base cap 60. When the supporting sleeve 30 is detached from the anchor 20, the anchoring opening 26 and retaining recess 28 are exposed on the anchoring surface 100, potentially allowing dirt, pebbles, and other objects to fall into and jam the retaining recess 28. The base cap 60 is adapted to cover the anchor 22 and the exposed anchoring opening 26, and may comprise a cap plate 61, and a peg 62 projecting from the center of the cap plate. The cap plate 61 may have a diameter which is larger, smaller, or substantially the same as the diameter of the base plate 22, while the peg 62 may have a diameter which is substantially the same as or smaller than the diameter of the anchoring opening 26 and anchoring recess 28. The base cap 60 may be placed over the anchor 20 such that the retaining recess 28 receives the peg 62 and the cap plate 61 rests over the upper face 22A of the base plate 22. The base cap 60 may be made from steel, aluminum, or other metal. The base cap 60 may alternatively be made from plastic or rubber.

It is understood that when an element is referred hereinabove as being "on" another element, it can be directly on the other element or intervening elements may be present therebetween. In contrast, when an element is referred to as being "directly on" another element, there are no intervening elements present.

Moreover, any components or materials can be formed from a same, structurally continuous piece or separately fabricated and connected.

It is further understood that, although ordinal terms, such as, "first," "second," "third," are used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

Spatially relative terms, such as "beneath," "below," "lower," "above," "upper" and the like, are used herein for ease of description to describe one element or feature's relationship to another element(s) or feature(s) as illustrated in the figures. It is understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device can be otherwise oriented (rotated 90 degrees or at other orientations) and the spatially relative descriptors used herein interpreted accordingly.

Example embodiments are described herein with reference to cross section illustrations that are schematic illustrations of idealized embodiments. As such, variations from the shapes of the illustrations as a result, for example, of manufacturing techniques and/or tolerances, are to be expected. Thus, example embodiments described herein should not be construed as limited to the particular shapes of regions as illustrated herein, but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

In conclusion, herein is presented an umbrella anchoring system. The disclosure is illustrated by example in the drawing figures, and throughout the written description. It should be understood that numerous variations are possible, while adhering to the inventive concept. Such variations are contemplated as being a part of the present disclosure.

What is claimed is:

1. An umbrella anchoring system for selectively supporting and anchoring an umbrella to a substantially planar anchoring surface, the anchoring surface has a top face, the umbrella has an umbrella pole and a canopy, the umbrella anchoring system comprising:

an anchoring recess which opens upwardly and is positioned below the top face of the anchoring surface;

a supporting sleeve comprising a tube having an open end, a closed end, a supporting sleeve outer surface, and a supporting sleeve inner surface, the supporting sleeve further comprising a supporting cavity which opens upwardly and is adapted to receive the umbrella pole, the supporting cavity is defined by the supporting sleeve inner surface and the open end, the supporting sleeve further comprising a retaining member which projects from the closed end of the supporting sleeve, the retaining member having a set of retaining member threads;

an anchor adapted to be affixed within the anchoring recess of the anchoring surface, the anchor comprising a base plate and an anchoring sleeve, the base plate is adapted to be oriented in parallel with the top face of the anchoring surface and has an upper face, a lower face, and an anchoring opening, the anchoring sleeve comprising an anchoring sleeve top joined to the lower face of the base plate, an anchoring sleeve bottom, an anchoring sleeve outer surface, and an anchoring sleeve inner surface, the anchor further comprising a retaining recess defined by the anchoring sleeve inner surface and the anchoring opening, the retaining recess opens upwardly through the anchoring opening and is sized to receive the retaining member, the retaining recess having a set of retaining recess threads;

wherein the retaining recess is adapted to selectively retain the retaining member to form a detachable connection between the supporting sleeve and the anchor whereby the retaining member threads and the retaining recess threads are adapted to rotatably interlock until the closed end of the supporting sleeve contacts the upper face of the base plate; and wherein the supporting sleeve is adapted to selectively support the umbrella in a vertical position whereby the umbrella pole is retained within the supporting cavity while the supporting sleeve is detachably connected to the anchor.

2. The umbrella anchoring system as described in claim 1, wherein the umbrella anchoring system further comprises a base cap having a cap plate and a peg, wherein the receiving recess is adapted to receive the peg such that the cap plate covers the base plate of the anchor.

3. The umbrella anchoring system as described in claim 2, wherein the supporting sleeve further comprises a tightening assembly, the tightening assembly is adapted to frictionally contact and lock the umbrella pole within the supporting cavity when the tightening assembly is engaged, and release the umbrella pole when the tightening assembly is disengaged.

4. The umbrella anchoring system as described in claim 3, wherein the tightening assembly comprises a tightening rod having a first end, and a tightening channel which passes through the supporting sleeve outer and inner surfaces, the first end of the tightening rod is adapted to rotatably extend through the tightening channel and frictionally contact the umbrella pole within the supporting cavity when the tightening assembly is engaged, and rotatably retract through the tightening channel when the tightening assembly is disengaged.

5. The umbrella anchoring system as described in claim 4, wherein the diameter of the supporting sleeve is larger than the diameter of the retaining member.

6. A method for selectively anchoring an umbrella to a substantially planar anchoring surface having a top face, the umbrella comprising an umbrella pole and a canopy supported by the umbrella pole, the method comprising the steps of:

providing a supporting sleeve having an open end, a closed end, a retaining member projecting downwardly from the closed end, and a supporting cavity, the supporting cavity opens upwardly at the open end and is adapted to receive the umbrella pole, the retaining member having a set of retaining member threads, the supporting sleeve and the retaining member each have a diameter, and the diameter of the supporting sleeve is greater than the diameter of the retaining member;

providing an anchor comprising a base plate and an anchoring sleeve, the base plate has an upper face, a lower face, and an anchoring opening, the anchoring sleeve projects downwardly from the lower face of the base plate, the anchor further comprises a retaining recess formed within the anchoring sleeve which opens upwardly through the anchoring opening of the base plate and is adapted to receive the retaining member, the retaining recess further having a set of retaining recess threads adapted to rotatably interlock with the retaining member threads;

forming an anchoring recess below the top face of the anchoring surface, the anchoring recess opens upwardly and is sized to receive the anchor;

affixing the anchor within the anchoring recess by positioning the anchor within the anchoring recess such that the upper face of the base plate is parallel with the top face of the anchoring surface;

detachably connecting the supporting sleeve to the anchor by positioning the retaining member within the retaining recess and rotating the supporting sleeve until the closed end of the supporting sleeve contacts the upper face of the base plate;

installing the umbrella by inserting the umbrella pole through the open end of the supporting sleeve and into the supporting cavity, whereby the supporting sleeve supports the umbrella in a vertical position;

removing the umbrella by withdrawing the umbrella pole from within the supporting cavity; and detaching the supporting sleeve from the anchor by reversibly rotating the supporting sleeve and withdrawing the retaining member from the retaining recess, and leaving the top face of the anchoring surface free of obstructions caused by the supporting sleeve or the anchor.

7. The method as described in claim 6, wherein:

the steps as recited further comprise the step of providing a base cap having a cap plate and a peg, wherein the receiving recess is adapted to receive the peg; and the step of detaching the supporting sleeve from the anchor is followed by the step of covering the anchor by placing the peg within the retaining recess and covering the base plate with the cap plate of the base cap.

8. The method as described in claim 7, wherein:

the supporting sleeve further comprises a tightening assembly adapted to lock the umbrella pole within the supporting cavity when the tightening assembly is engaged, and release the umbrella pole within the supporting cavity when the tightening assembly is disengaged;

the step of installing the umbrella is followed by the step of engaging the tightening assembly to lock the umbrella pole within the supporting cavity; and the step of removing the umbrella is preceded by the step of disengaging the tightening assembly to release the umbrella pole within the supporting cavity.

9. The method as described in claim 8, wherein:

the anchoring surface comprises wet concrete;

the step of forming an anchoring recess comprises forming an anchoring recess by embedding the anchor within the anchoring surface to form the anchoring recess, whereby the wet concrete of the anchoring surface conforms to the shape of the anchor; and the step of affixing the anchor within the anchoring recess comprises positioning the anchor so that the upper face of the base plate is coplanar with the top face of the anchoring surface, and allowing the wet concrete of the anchoring surface to cure and permanently affix the anchor within the anchoring recess.

10. The method as described in claim 8, wherein the step of affixing the anchor within the anchoring recess comprises applying an adhesive within the anchoring recess, positioning the anchor within the anchoring recess so that the upper face of the base plate is coplanar with the top face of the anchoring surface, and allowing the adhesive to cure and permanently affix the anchor within the anchoring recess.

* * * * *